United States Patent [19]

Hinchcliffe

[11] 4,249,849

[45] Feb. 10, 1981

[54] CONVEYOR SYSTEM FOR ROD-LIKE ARTICLES

[75] Inventor: Dennis Hinchcliffe, London, England

[73] Assignee: Molins Limited, England

[21] Appl. No.: 967,102

[22] Filed: Dec. 7, 1978

[30] Foreign Application Priority Data

Dec. 21, 1977 [GB] United Kingdom ..... 53150/77

[51] Int. Cl.[3] ..... B65G 47/52

[52] U.S. Cl. ..... 414/404; 53/148; 414/417

[58] Field of Search ..... 414/404, 417; 53/148, 53/236; 198/347

[56] References Cited

U.S. PATENT DOCUMENTS

| | | | |
|---|---|---|---|
| 3,308,600 | 3/1967 | Erdmann | 53/148 X |
| 3,923,173 | 12/1975 | Schubert | 414/404 |
| 4,099,637 | 7/1978 | Molins | 414/417 X |
| 4,170,285 | 10/1979 | Hinchcliffe | 53/148 X |

*Primary Examiner*—Stephen G. Kunin
*Assistant Examiner*—Terrance L. Siemens
*Attorney, Agent, or Firm*—Craig & Antonelli

[57] ABSTRACT

A conveyor system for rod-like articles such as cigarettes uses compartmented trays adapted for insertion into a holder. Successive compartments of the tray are filled longitudinally with multi-layer batches of the articles delivered on a separator conveyor. Filled compartments are intermittently transversely moved into the holder. Holders containing full trays firmly retain the articles in the trays so that handling of the tray/-holder combination is facilitated. The system is reversible so that trays may be unloaded by delivery of batches onto the conveyor between the separators.

20 Claims, 2 Drawing Figures

CONVEYOR SYSTEM FOR ROD-LIKE ARTICLES

This invention relates to conveyor systems for rod-like articles such as cigarettes or cigarette filter rods. In manufacturing processes for such articles it is common to require the articles to be transported or temporarily stored in containers.

SUMMARY OF THE INVENTION

According to the invention a conveyor system comprises conveyor means for moving rod-like articles in a direction transverse to their lengths into a container, retaining means for retaining said articles in the container, and means for moving the container relative to the retaining means in a direction parallel to the lengths of said articles, so that the container is at least partly inserted in a holder which subsequently retains said articles in the container.

The articles are preferably moved into and stored in the container as a substantially rectangular stack. Each container may be adapted to confine the stack on three parallel sides so that the stack may be moved into the container longitudinally. The holder preferably comprises a rectangular open-ended sleeve for receiving and holding one or more containers. Each container may be a compartment of a tray having several parallel compartments. The retaining means may comprise spaced divider plates carried by an endless band conveyor constituting said conveyor means. The divider plates could be movable in a direction transverse to the conveyor to create container-length batches from a substantially continuous stream.

The container-moving means may be reversible so that articles in a container in a holder may be transferred to said conveyor means. The conveyor means is preferably also reversible. Where the retaining means comprises spaced divider plates carried by the conveyor means the divider plates may be movable in a direction transverse to the conveyor means so that they can be retracted downstream of said transfer position to leave a substantially continuous stream formed by successive stacks transferred onto the conveyor means.

The conveyor system may include means for handling containers on one side of the conveyor means, and means for handling container holders on the other side of the conveyor means, the container-moving means being arranged to move a container from said one side to said other side of the conveyor means to receive a batch of rod-like articles and carry it into a holder, and move a container in the opposite direction to remove it from a holder and transfer a batch onto the conveyor means between said retaining means.

Figure 1:
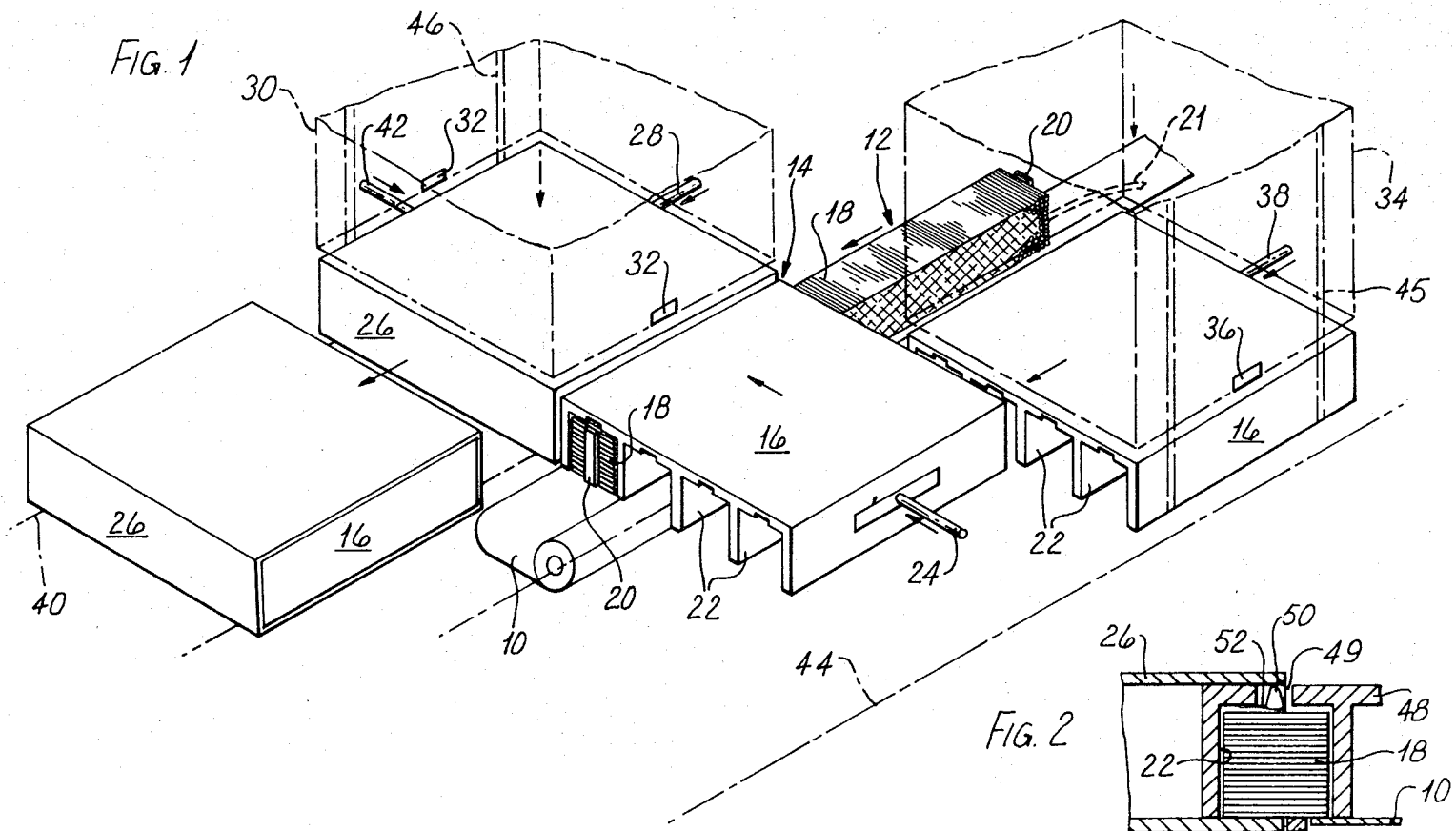
Figure 2:
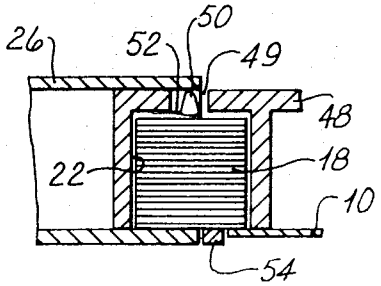

The invention will be further described, by way of example only, with reference to the accompanying diagrammatic drawings, in which:

FIG. 1 is a perspective view of a conveyor system for rod-like articles, and FIG. 2 is a sectional view of a detail modification of the system of FIG. 1.

The conveyor system shown includes an endless band conveyor 10 for moving a stream 12 consisting of a stack of parallel rod-like articles towards or away from a transfer position 14 at which trays 16 are loaded or unloaded. The stream 12 is separated into batches 18 on the conveyor 10 by regularly-spaced divider plates 20 carried by the conveyor. The divider plates 20 are movable relative to the surface of the conveyor 10 and may be successively projected into a continuous stream to form batches (or withdrawn to reform a continuous stream) at a position generally to the right of the part of the system shown in FIG. 1, in any convenient way, for example as disclosed in British Patent Specification No. 1,404,141 or U.S. Pat. No. 4,029,197. Cam means for moving the divider plates 20 is indicated at 21 in FIG. 1. Alternatively the conveyor 10 could have fixed divider plates, as disclosed for example in British Patent Specification No. 1,537,051, the batches being formed by feeding a stream of rod-like articles downwards onto the conveyor.

Each tray 16 defines four compartments 22 which are bounded on three sides, so that they are open on one side and at both ends. The width of each compartment 22 slightly exceeds the length of the rod-like articles in the stream 12, and the length of each compartment corresponds to the length of a batch 18, being slightly less than the distance between adjacent divider plates 20.

In the position shown in FIG. 1, the batch 18 at the transfer position 14 is supported on the conveyer 10 within the first compartment 22 of a tray 16. Assuming that the system is operating to load trays 16 and is initially stationary in the position shown in FIG. 1, a pusher 24 moves the tray transversely of the conveyor 10 so that the batch 18 is displaced by movement of the compartment 22 and carried with it into the first part of a tray holder 26 located on the opposite side of the conveyor. The tray holder 26 comprises a rectangular sleeve open at both ends and having internal dimensions slightly exceeding the external dimensions of a tray 16 so that the tray is a sliding fit in the holder. The movement of the pusher 24 displaces the batch 18 in the first compartment 22 and positions the second compartment 22 over the conveyor 10. Subsequently, the conveyor 10 is moved through a distance equal to the spacing between divider plates 22, so that the next batch 18 is at the transfer position 14 and within the second compartment 22. The conveyor 10 is then stopped and the pusher 24 operated to push the tray 16 further into the holder 26 and bring the next empty compartment 22 over the conveyor.

The intermittent movement of conveyor 10 and pusher 24 continues until all the compartments 22 of the tray 16 are filled and the tray fully inserted in the holder 26. The holder 26, together with its full tray 16, is then moved away from the transfer position by a pusher 28 (or other conveyor means, e.g. a band conveyor 40). A further holder 26 is released from stacking means 30 by releasable catch means 32 (which may be solenoid-operated, for example) and descends to the transfer position 14. At about the same time the pusher 24 is fully withdrawn so that an empty tray 16 released from stacking means 34 by catch means 36 may be delivered into the path of pusher 24 by a further pusher 38 (or other conveyor means, e.g. a band conveyor 44). The empty tray 16 may then be moved into the transfer position 14 by the pusher 24.

In a slightly modified way of operating the system the next empty tray 16 may be moved into alignment with the transfer position 14 whilst the last compartment 22 of the previous tray is being filled. Subsequently, the filled tray is pushed into its holder by movement of the empty tray into its first loading position under action of the pusher 24. The full tray and holder 26 can then be moved away and an empty holder placed in position whilst the first compartment of the new tray is being filled (i.e. whilst the conveyor 10 is running).

Use of the system for unloading trays 16 may, in general, be a reversal of the loading process. Holders 26 containing full trays 16 may be moved on conveyor band 40 towards the transfer position 14 (i.e. to the right as viewed in FIG. 1). When in position, the tray 16 is progressively intermittently pushed out of its holder 26 by means of a pusher 42, so that successive batches are transferred out of successive compartments 22 and carried away by the conveyor 10. The empty tray is pushed fully out of its holder 26 and onto the other side of the conveyor 10, from where it is moved away on conveyor band 44 (or by a pusher, not shown) to a position underneath the stacking means 34. Lifting means 45 (which could comprise pairs of chains provided with spaced ledges, as disclosed in British Patent Specification No. 1,404,141) may be provided to stack empty trays 16 in the stacking means 34: the lifting means could cooperate with or replace the catch means 36. Similarly, lifting means 46 could be provided for the stacking means 30 for stacking empty holders 26.

Since unloading is a direct reversal of loading, including storage of empty trays 16 and holders 26, the system is operable reversibly. Moreover, reversal could occur at any stage, including during filling or unloading of a compartment 22. If direct reversal of the system is not required, holders containing full trays may be supplied to the transfer position 14, and empty trays and holders removed, in any convenient way, without stacking.

The pushers 24, 28, 38, 42 are preferably operated by hydraulic or pneumatic pistons. The bands 40 and 44, which are moved intermittently during unloading, may be reversible and perform the functions of the pushers 28 and 38 during loading. Alternatively, the functions of the bands 40 and 44 during unloading may be performed by pushers or the like. The side edges of the divider plates 20 and the edges of the holder 26 are preferably bevelled or rounded so that the ends of the articles at each end of a batch 18 are not damaged by movement into the holder during loading or by movement between the divider plates during unloading.

FIG. 2 is a sectional view showing a modified tray 48 partly inserted in a holder 26. The tray 48 is similar to the tray 16 except that it is provided with compartments 22 having one or more slots 49 through which project cam abutments 50 carried by leaf springs 52 attached to the upper inner surface of each compartment. As a tray 48 is inserted into its holder 26 the abutment 50 is pressed down by the inner surface of the holder and the leaf spring in turn presses on the upper articles in a batch 18 to lightly clamp the articles within the compartment 22 whilst it is in the holder 26. Also shown in FIG. 2 is a narrow dead plate 54 between the conveyor 10 and holder 26.

The provision of means for lightly clamping the batches 18 whilst in the holder 26, together with means (e.g. spring clips) for firmly retaining the trays 16, 48 in the holders, allows subsequent handling of the holder/-tray combination which is not possible with conventional containers for rod-like articles. In particular, the orientation of the combination is relatively unimportant and it may safely be subjected to the rapid accelerations and decelerations usually associated with high speed conveyance (e.g. a pneumatic and/or track system).

The conveyor 10 may be connected to or form part of conveyor means linking one or more cigarette making machines to one or more cigarette packing machines, the conveyor system having tray loading and unloading apparatus constituting a buffer or reservoir for accommodating cigarettes when the production of the makers exceeds the demand of the packers or for supplying cigarettes to the conveyor (and thence to the packers) when the production falls short of demand. The system may be automatically reversible and may operate in an analogous way to the storage unit disclosed in British Patent Specifications Nos. 1,404,141 and 1,404,142. Sensors capable of monitoring the supply/demand situation and controlling the system automatically are described in British Patent Specification No. 1,299,174. The conveyor 10 could form part of the storage device in any of the conveyor systems described in British Patent Specification No. 1,453,191.

The conveyor 10 could extend on both sides of the transfer position 14, so that it need not be reversible, and unloaded batches could be moved away to the left as viewed in FIG. 1. There could be more than one transfer position 14 on the conveyor 10.

The system, when used in its loading mode, could form the basis of a relatively cheap packing machine for rod-like articles if the trays and holders were of sufficiently cheap construction (so that they could be used by the manufacturers for supply of the rod-like articles).

I claim:

1. A conveyor system for rod-like articles comprising at least one container; at least one container holder; conveyor means for moving rod-like articles in a direction transverse to their lengths into the container; retaining means for retaining said articles in the container; and means for moving the container relative to the retaining means in a direction parallel to the lengths of said articles, so that the container is at least partly inserted in said container holder which subsequently retains said articles in the container.

2. A conveyor system as claimed in claim 1, wherein the container and retaining means are adapted to confine a substantially rectangular stack of rod-like articles.

3. A conveyor system as claimed in claim 2, wherein the container is adapted to confine the stack on three sides so that the stack may be moved into the container longitudinally.

4. A conveyor system as claimed in claim 3, including resilient means adapted to lightly clamp a batch of rod-like articles in a container in a holder.

5. A conveyor system as claimed in claim 2, wherein the container holder comprises a rectangular open-ended sleeve for receiving and holding one or more containers.

6. The conveyor system as claimed in claim 2, wherein each container is a compartment of a tray having several parallel compartments.

7. A conveyor system as claimed in claim 2, wherein the retaining means comprises spaced divider plates carried by said conveyor means.

8. A conveyor system as claimed in claim 7, wherein the divider plates are movable in a direction transverse to the bottom of the stack on the conveyor means.

9. A conveyor system as claimed in claim 1, wherein said container-moving means is reversible so that articles retained in a container in a container holder may be transferred to said conveyor means.

10. A conveyor system as claimed in claim 9, wherein said conveyor means is reversible to remove articles from a container.

11. A conveyor system as claimed in claim 1, including means for handling containers on one side of the conveyor means, and means for handling container holders on the other side of the conveyor means, wherein the container-moving means is arranged to move a container from said one side to said other side of the conveyor means to receive a batch of rod-like articles and carry it into a container holder, and move a container in the opposite direction to remove it from a container holder and transfer a batch onto the conveyor means between said retaining means.

12. A conveyor system as claimed in claim 11, wherein said means for handling containers includes means for stacking containers.

13. A conveyor system as claimed in claim 11, wherein said means for handling container holders includes means for stacking said container holders.

14. A conveyor system for rod-like articles comprising at least one open-ended container adapted to contain a stack of parallel rod-like articles; means for moving said container carrying a stack along a path parallel to said articles; first retaining means adjacent said path for retaining the ends of the stack; conveyor means movable in a direction perpendicular to said path and defining an intersection with said path at a position downstream of said first retaining means in the direction of movement of said container; and second retaining means carried by said conveyor means for retaining the ends of the stack and for removing the stack from said container in a direction transverse to the lengths of the articles.

15. A conveyor system as claimed in claim 14, wherein said first retaining means is part of a container holder adapted to receive a container.

16. A conveyor system as claimed in claim 14, wherein said second retaining means comprises spaced divider plates carried by said conveyor means.

17. A conveyor system as claimed in claim 16, including means for retracting said divider plates at a position downstream of said intersection to leave a substantially continuous stream formed by successive stacks transferred onto said conveyor means.

18. A conveyor system for rod-like articles comprising conveyor means for moving rod-like articles in stack formation in a direction transverse to the lengths of the articles; spaced divider means carried by said conveyor means for separating a stream of articles on said conveyor means into batches; means for handling containers on one side of the conveyor means; and means for handling container holders on the other side of the conveyor means; container-moving means for moving a container from said one side to said other side of said conveyor means to cause said container to receive a batch of rod-like articles therein and carry it into a container holder, and for moving a container in the opposite direction to remove it from a container holder and transfer a batch of rod-like articles therefrom onto said conveyor means between said spaced divider means.

19. A conveyor system for rod-like articles comprising first means for bounding a substantially rectangular stack of parallel rod-like articles on three sides; second means for bounding said stack on the remaining three sides; means for intermittently moving said first and second means respectively on first and second intersecting perpendicular paths for transfer of said stack between said paths; and third means on said second path adjacent said first path for bounding said stack on said first three parallel sides.

20. A conveyor system for rod-like articles, including at least one open-ended container adapted to contain a stack of parallel rod-like articles, means defining a path for said container, conveyor means for moving a stream of rod-like articles in stack formation in a direction transverse to the lengths of the articles into said container on said path, first retaining means associated with said conveyor for retaining the ends of a stack on the conveyor, means for moving the container on said path in a direction parallel to the articles in said container, and second retaining means for retaining the ends of a stack in the container on said path.

* * * * *